US006256928B1

(12) United States Patent
Skeem

(10) Patent No.: US 6,256,928 B1
(45) Date of Patent: Jul. 10, 2001

(54) GATE OPENER WITH LINEAR AND ARCUATE MOTION

(76) Inventor: Dan Skeem, 4928 Murray Blvd., Murray, UT (US) 84123-2623

( * ) Notice: Subject to any disclaimer, the term of this patent is extended or adjusted under 35 U.S.C. 154(b) by 0 days.

(21) Appl. No.: 09/420,143

(22) Filed: Oct. 18, 1999

(51) Int. Cl.[7] ..... E05F 11/24
(52) U.S. Cl. ..... 49/341; 49/340
(58) Field of Search ..... 49/324, 339, 340, 49/341, 342, 345

(56) References Cited

U.S. PATENT DOCUMENTS

| | | | | |
|---|---|---|---|---|
| 4,025,104 | * | 5/1977 | Grossbach et al. | 49/345 X |
| 4,934,203 | * | 6/1990 | Bailey et al. | 49/340 X |
| 5,351,440 | * | 10/1994 | Vincent | 49/340 |
| 5,804,938 | * | 9/1998 | Richmond et al. | 49/340 X |

FOREIGN PATENT DOCUMENTS

| | | | |
|---|---|---|---|
| 2 689 171 | 10/1993 | (FR) | 49/345 |

OTHER PUBLICATIONS

Publication, "Space Requirements (Standard Installation)," Automatic Gate Supply Company Catalog, on information and belief, available in Sep., 1995.

* cited by examiner

*Primary Examiner*—Jerry Redman

(57) ABSTRACT

An automated gate assembly, includes (i) a post; (ii) a gate pivotally coupled to the post, the gate pivoting between an open position and a closed position; and (iii) a gate opening assembly coupled to the gate. The gate opening assembly includes: (i) a pivoting assembly which selectively and simultaneously moves in both a linear and arcuate direction; and (ii) a connector connecting the pivoting assembly to the gate whereby actuation of the pivoting assembly rotates the gate from the open position to the closed position. The automatic gate assembly is particularly advantageous for mounting an automatic gate opening assembly on one side of a square or rectangular post while the gate is pivotally mounted on an adjacent side. A connector is able to readily clear the comer between the adjacent sides of the posts because of the unique configuration of the opening assembly.

22 Claims, 8 Drawing Sheets

GATE OPENER WITH LINEAR AND ARCUATE MOTION

BACKGROUND OF THE INVENTION

1. The Field of the Invention

This invention is in the field of automatic gate openers and gate assemblies with automatic gate openers. More specifically, this invention is in the field of automatic gate openers and gate assemblies with automatic gate openers.

2. The Relevant Technology

Gate assemblies have long been used for a variety of purposes including demarking property boundaries, allowing selective access of individuals or animals into a desired area, or for decoration. Gate assemblies typically comprise: (i) a gate; and (ii) a pole, pillar or other structure upon which the gate is movably mounted, collectively known herein as a "post." Gates may be formed from a variety of different members, including, for example, chain link materials, vertical beams coupled to upper and lower horizontal bars, a series of wooden slats, or a solid sheet of material such as metal or wood.

Gates are typically pivotally mounted to a respective post through the use of one or more hinges, for example. In certain embodiments a single gate is mounted on a single post. In other settings, a first gate is mounted on one side of a road or walkway while a second gate is mounted on an opposing side of the road.

Over time it has been discovered that gates can be conveniently opened through automated processes. Such automated processes include, by way of example, motors used to mechanically open gates and electronic devices used to trigger such motors. In light of such automation, gate opening has become significantly more convenient.

For example, cars, trucks, and other automobiles can now approach a gate, signal the gate to be opened, then drive through the gate, after which the gate automatically closes. Such signals can take various forms. Optionally, a user can open a gate from a control panel, then walk through the gate without having to manually push the gate open or closed.

One style of post which has become popular is the square or rectangular shaped post. Such posts can stand alone or can be positioned at the end of a fence, for example. Rectangular and square posts each have a first substantially planar face and a second substantially planar face which is oriented transversely to the first substantially planar face. It is typical for gate owners to pivotally mount a gate in the center of the first substantially planar face of the post for functional and/or aesthetic reasons. Mounting the gate in the center of the face may provide a more solid coupling of the gate to the post, than a mounting on the comer of the post, for example.

Despite the aesthetic and mechanical advantages of gate assemblies having gates mounted in the center of a face of a square or rectangular shaped post, one major problem relates to the attempt to operate an automatic opener coupled to the gate. When a gate is mounted in the center of such a post face, it is often difficult, if not impossible to couple an automatic gate opening assembly to the post without significantly impairing the range of motion of the gate opening assembly or without cutting the comer of the post away from the post. The comer of the post typically interferes with the range of motion of the gate opening assembly.

Consequently, gate assemblies typically feature gates coupled to a comer of a post with a motor of an automatic opening assembly coupled to a face of the post adjacent the comer of the post. Typical such automated gate opening assemblies feature a connector coupled between the motor and the comer mounted gate. The connector may be in the form of a hydraulic ram, for example.

The mounting of a gate on the comer of a post may be acceptable to many gate owners. However, the lack of clearance suffered by gate assemblies having centrally mounted gates is particularly problematic when gate owners have existing manually operated gates mounted in the center of a square or rectangular shaped post and desire to retrofit an automated gate opening assembly onto the existing gate assembly. It is typically a labor intensive effort to move the pivot point of the gate to achieve a convenient coupling of the gate to the corner of the post in order to avoid a clearance problem.

A further problem associated with typical gate opening assemblies is that typical connecting arms of such assemblies are required to be long in order to properly move the gate in a desired direction.

An example of a prior art attempt to overcome this phenomenon is depicted from a top view in FIG. 1. FIG. 1 features a gate assembly 1*a* comprising a post 2*a*, a gate 3*a* pivotally mounted to post 2*a*, a motor 4*a* configured to selectively, automatically open gate 3*a*, and a connector 5*a*. Fence 6*a* is coupled to post 2*a*. As shown, in order to enable connector 5*a* to clear post 2*a* as connector moves gate 3*a* between the open position 7*a* and the closed position 8*b*, motor 4*a* is mounted offset from post 2*a*. This is inconvenient because a separate stand is required for motor 4*a* and motor 4*a* takes up a significant amount of space while offset from post 2*a*. It is also not aesthetically pleasing to have motor 4*a* offset from post 2*a*. A second post is shown at 9*a*.

There is therefore a need in the art for an improved gate assembly. More specifically, there is a need in the art for an improved gate opening assembly which achieves a greater range of motion than existing gate opening assemblies and is not required to be coupled to a corner of a post. There is also a need in the art for a gate assembly which can be conveniently retrofit onto one side of a post while a gate is mounted on a transverse side of the post remotely from the corner of the post.

SUMMARY AND OBJECTS OF THE INVENTION

It is therefore an object of the invention to provide an improved gate assembly.

It is another object of the invention to provide an improved gate opening assembly.

It is another object of the invention to provide an improved gate opening assembly which achieves a greater range of motion than existing gate opening assemblies and is not required to be coupled to a comer of a post.

It is another object of the invention to provide an improved gate opening assembly which can be conveniently retrofit onto one side of a post while a gate is pivotally mounted on a transverse side of the post remotely from the comer of the post.

It is another object of the invention to provide a gate assembly having a gate opening assembly which can be employed when the pivot point of the gate is located in the center portion of a square or rectangular-shaped post.

It is another object of the invention to provide a gate opening assembly which enables a practitioner to conveniently automate a preexisting, manually operated gate.

An automated gate assembly of the present invention comprises: (i) a post; (ii) a gate pivotally coupled to the post;

and (iii) a gate opening assembly coupled to the gate. The gate pivots between an open position and a closed position.

The gate opening assembly comprises: (i) a pivoting assembly which selectively and simultaneously moves in both a linear and arcuate direction; and (ii) a connector connecting the pivoting assembly to the gate. Actuation of the pivoting assembly rotates the gate from the open position to the closed position.

Since the pivoting assembly moves in both a linear and an arcuate direction, the connector achieves a vastly improved range of motion and is able to readily clear or negotiate a comer of a post. For example, in one embodiment, the closed position of the gate is approximately 90 degrees away from the open position of the gate. The pivoting assembly rotates approximately 180 degrees in order to rotate the gate 90 degrees from the closed position to the open position. The ratio of rotation between the pivoting assembly and the gate in such an embodiment is thus approximately 2:1.

Also in one embodiment, the post has first and second substantially planar faces wherein the first substantially planar face is substantially transverse to the second substantially planar face and the gate is pivotally coupled to the first substantially planar face remotely from the comer of the post, which is at the intersection of the faces.

For example, the gate can be pivotally coupled to the center of a first substantially planar surface of the post. The pivoting assembly can be coupled to the second substantially planar face of the post, yet nevertheless cause the connector to conveniently negotiate the corner of the post.

The gate assembly of the present invention can thus conveniently comprise a square post, a rectangular post, or a variety of different posts having a comer intersecting first and second substantially planar, substantially transverse faces. The gate assembly can also function effectively on round or irregular shaped posts as well.

The connector comprises at least one member, such as a pivot arm coupled to the pivoting assembly and the gate. In one embodiment, the connector comprises: (i) a pivot arm having a first end coupled to the pivoting assembly and a second end; and (ii) a link arm having a first end pivotally coupled to the second end of the pivot arm and a second end pivotally coupled to the gate. However, a variety of different configurations for the pivoting assembly and connector are available to achieve the improved range of motion achieved when the pivoting assembly moves the pivot arm in both a linear and arcuate direction. For example, in one embodiment, the link arm and/or the pivot arm comprise a telescoping assembly which selectively adjusts in length, such that the length of the connector can be selectively adjusted.

The gate opening assembly of the present invention has a variety of different advantages. For example, the opening assembly is readily retrofit onto a variety of different existing posts having gates pivotally mounted thereon, including gates which are mounted in the center of square or rectangular posts. This dynamic enables owners of gates centrally located on posts to achieve convenient automation which was previously not available.

In addition, the gate opening assembly of the present invention has better leverage and mechanical properties than previous designs. Mounting the pivoting assembly at close proximity to the gate hinges allows the optimum gate to power source distance. The gate opening assembly can also be a smaller, more compact unit. Furthermore, the opening and closing of the gate is more gradual and less sudden than previous designs.

In addition, the gate opening assembly can be operated at any angle. Thus, the gate opening assembly can be employed in conjunction with swing gates, which swing side to side, tilt gates, which tilt up and down, and a variety of other gate styles. Examples of tilt gates which can be operated using the automatic gate opening assembly of the present invention include tilting arms (such as typically used in parking lot entrances and exits, for example) and small, medium and large tilting gates which tilt up and down. Furthermore extra cement or other mounting means are not required to mount the gate opening assembly way from a gate post.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 2:
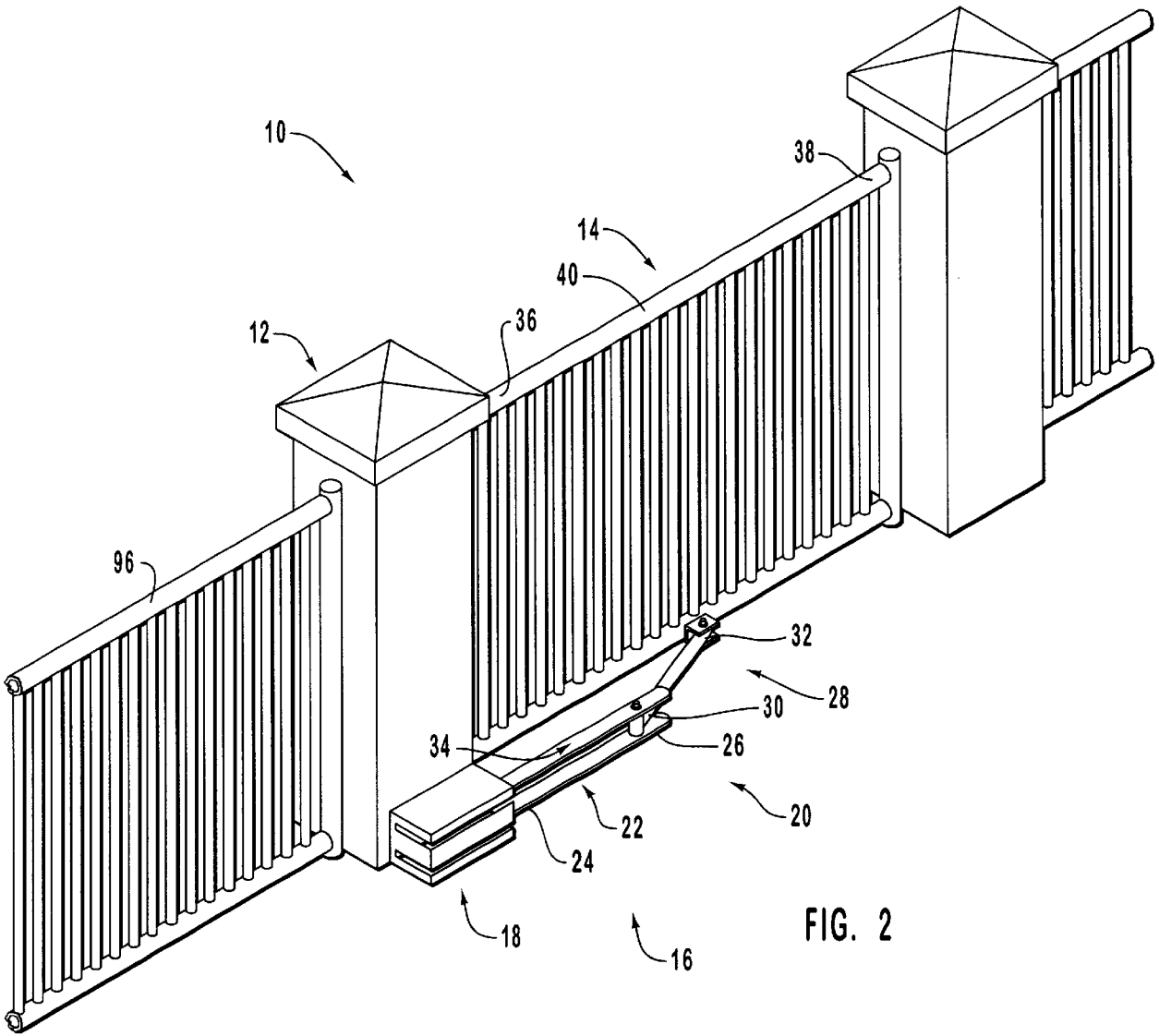
FIG. 2 demonstrates an example of a gate assembly of the present invention wherein the gate is in a closed position.
Figure 3:
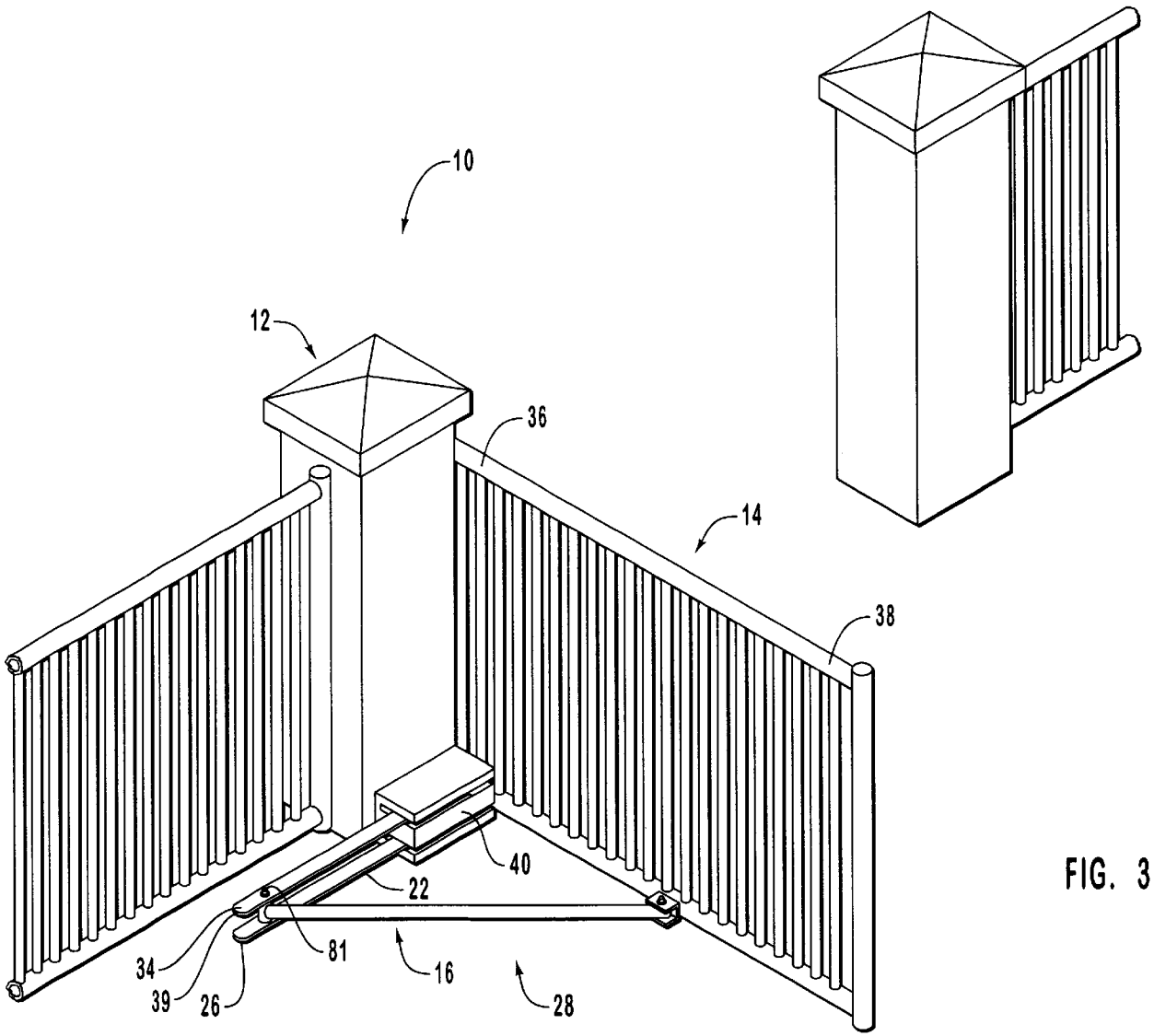
FIG. 3 demonstrates the gate assembly of FIG. 2, wherein the gate is in an open position.

With reference now to FIGS. 2 and 3, an automated gate assembly 10 of the present invention is shown in a closed position in FIG. 2 and in an open position in FIG. 3. As shown, gate assembly 10 comprises a first post 12, a gate 14 pivotally coupled to first post 12, and a gate opening assembly 16 coupled at one end thereof to first post 12 and at an opposing thereof to gate 14. Gate 14 pivots between the closed position of FIG. 2 and the open position of FIG. 3.

Gate opening assembly 16 comprises (i) a pivoting assembly 18 which selectively and simultaneously moves in both a linear and arcuate direction; and (ii) a connector 20 connecting pivoting assembly 18 to gate 14. Actuation of pivoting assembly 18 selectively rotates connector 20 back and forth between first and second positions, thereby selectively moving gate 14 back and forth between the closed position and the open position.

Since pivoting assembly 18 moves in both a linear and an arcuate direction, connector 20 achieves a vastly improved range of motion and is able to readily clear or negotiate a corner of post 12. For example, in one embodiment, the closed position of gate 14 is approximately 90 degrees away from the open position of gate 14. Pivoting assembly 18 rotates approximately 180 degrees in order to rotate gate 14 approximately 90 degrees from the closed position to the open position. The ratio of rotation between pivoting assembly 18 and gate 14 in such an embodiment is thus approximately 2:1.

Figure 1:
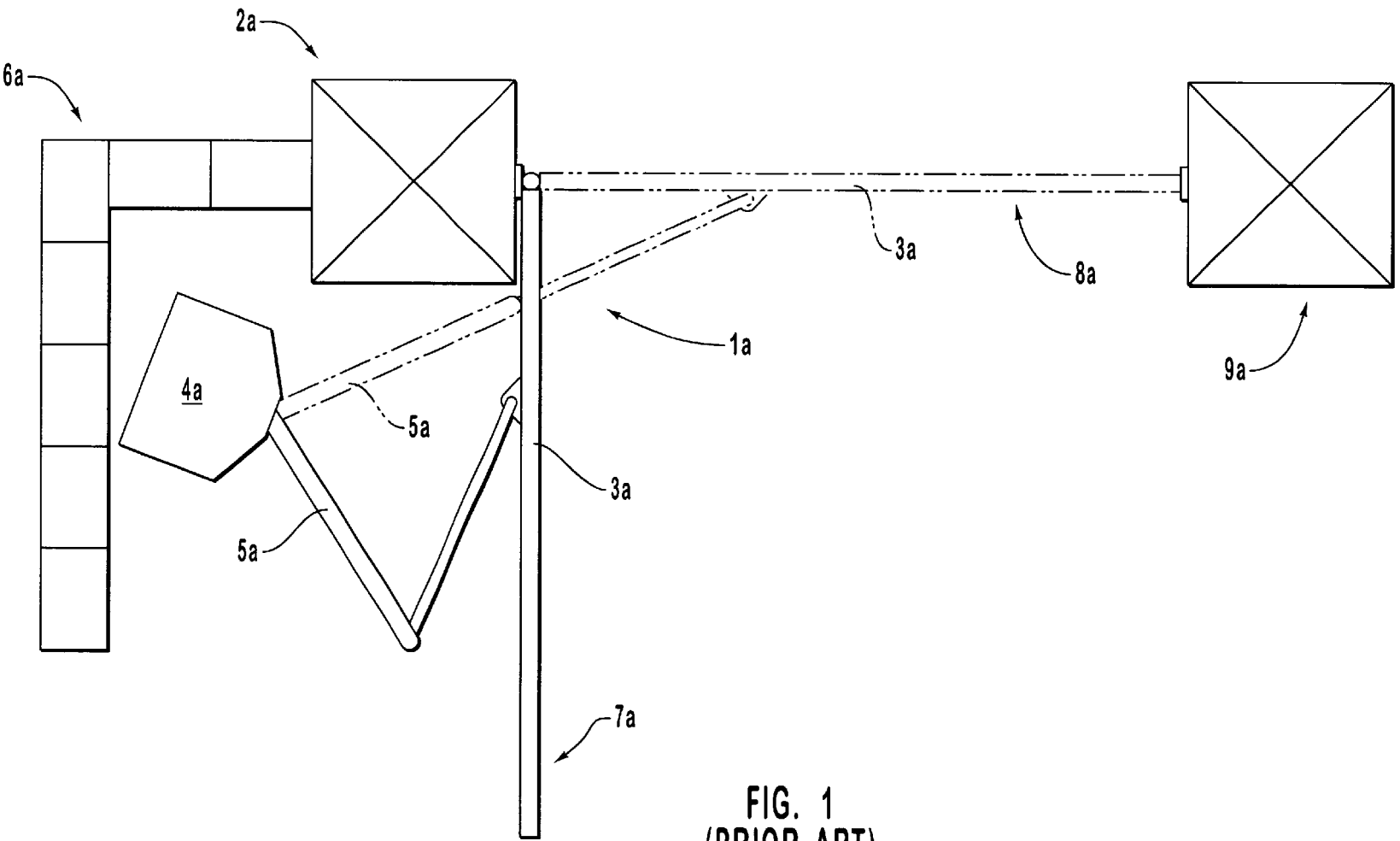
FIG. 1 (PRIOR ART)
FIG. 1 is a depiction of a prior art gate assembly.

In the embodiment of FIG. 1, connector 20 comprises: (i) a pivot arm 22 having a first end 24 coupled to pivoting assembly 18 and a second end 26; and (ii) a link arm 28 having a first end 30 pivotally coupled to second end 26 of pivot arm 22 and a second end 32 pivotally coupled to gate 14.

In a preferred embodiment, assembly 16 comprises first and second pivot arms 20, 34 which are pivotally coupled to link arm 28. However, it will be appreciated that one or more pivot arms may be coupled to one or more link arms. (An example of a single pivot arm which links to a single or dual link arms is shown in FIG. 4*a*.)

With continued reference to FIGS. 2 and 3, gate 14 has first end 36 and second end 38 and an intermediate portion 40 therebetween. Second end 32 of link arm 28 may be pivotally coupled to second end 38 of gate 14 or any portion of gate 14 intermediate first and second ends 36, 38.

Upon actuating assembly 16, second ends 26, 39 of pivot arms 22, 34 both move in an arcuate direction and in a linear direction away from or toward gate 14, thereby moving link arm 28 such that gate 14 opens. Upon actuating assembly 16, gate 14 can be pivoted approximately 90° because opening assembly 16 is not interfered with by gate 14 or by post 12. Instead, pivot arms 22, 34 and link arm 28 are extended away from the comer of post 12.

Figure 4:
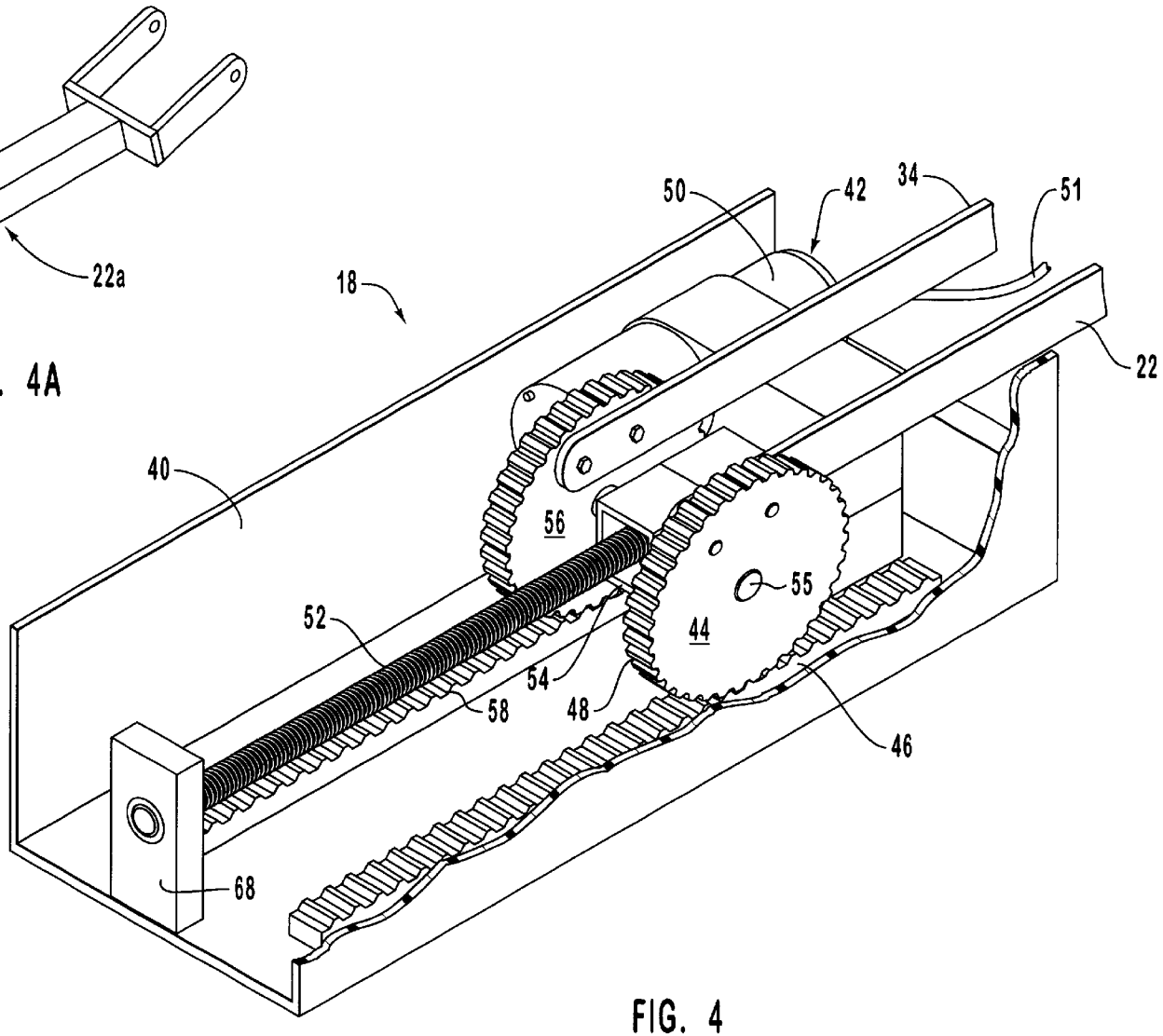
FIG. 4 demonstrates a cutaway view of the gate opening assembly of the present invention with the pivot arms of the assembly in a first position. The link arms of the assembly are not shown in FIG. 4.
Figure 4A:
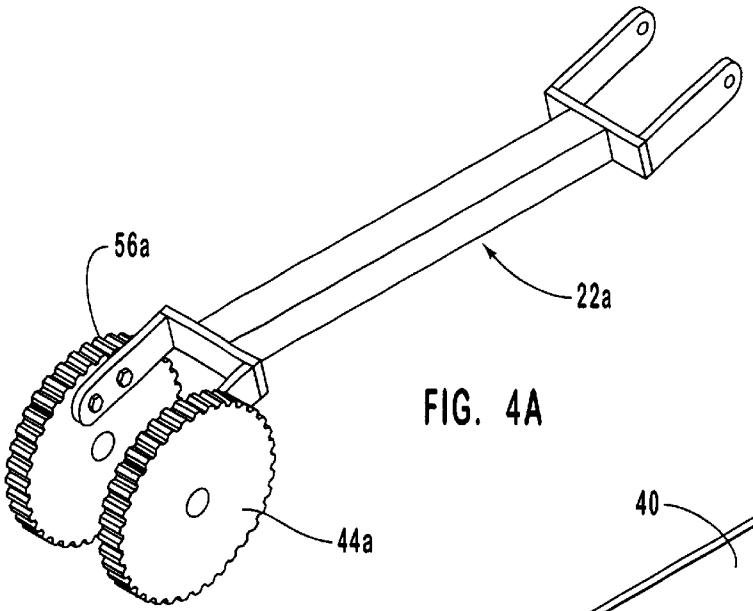
FIG. 4*a* demonstrates an alternate pivot arm of the present invention.
Figure 5:
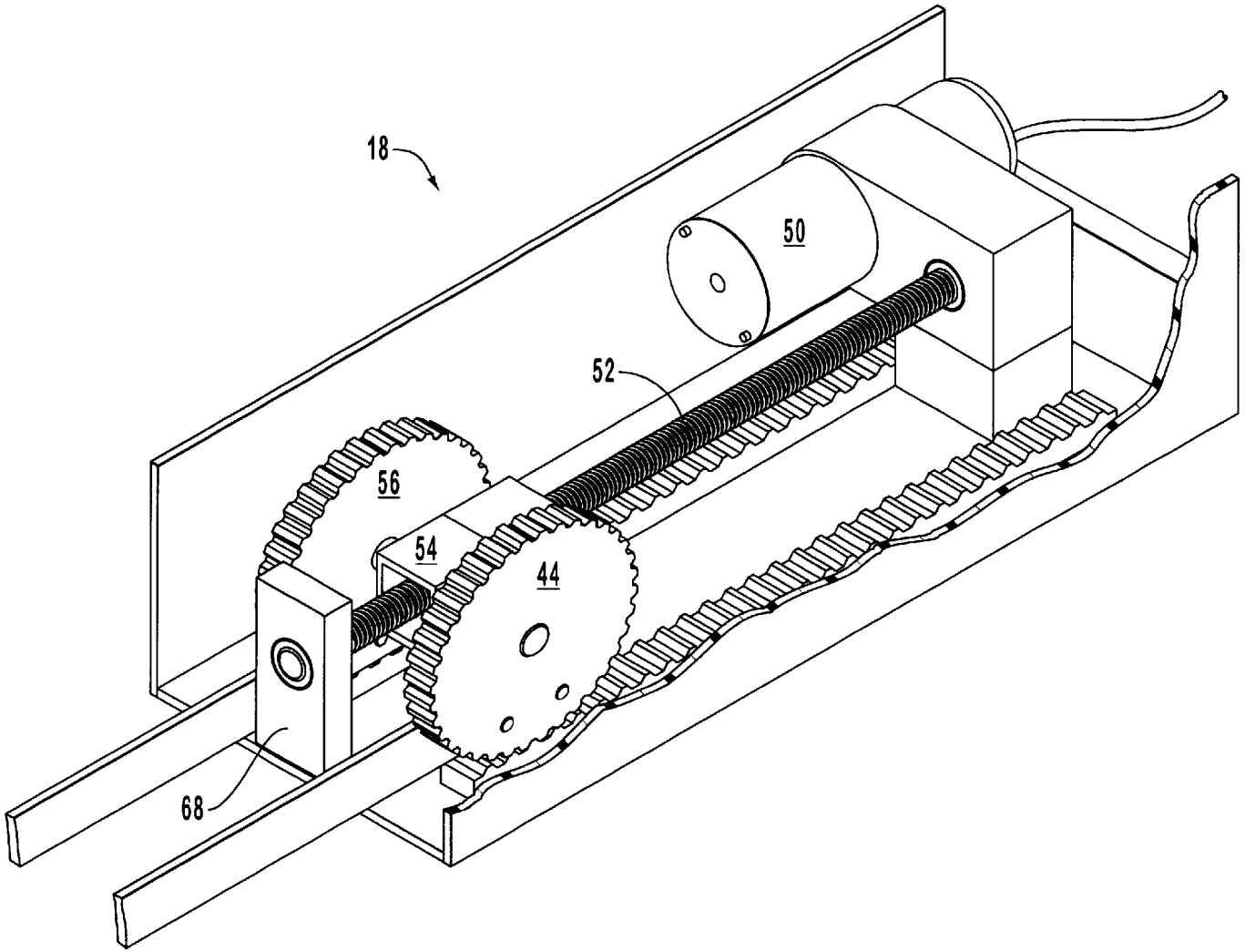
FIG. 5 demonstrates the assembly of FIG. 4 with the pivot arms moved to a second position.

An example of pivoting assembly 18 of FIGS. 2 and 3 is shown in a cut-away view in FIG. 4. In the embodiment of FIG. 4, pivoting assembly 18 comprises: (i) a housing 40 (shown in cutaway view in FIG. 4); (ii) a drive screw assembly 42 coupled to housing 40; (iii) at least one toothed gear 44 pivotally coupled to drive screw assembly 42; and (iv) at least one toothed rack 46 coupled between housing 40 and toothed gear 44 so as to interface with teeth 48 of gear 44.

In the embodiment of FIG. 3, drive screw assembly 42 comprises (i) a drive motor 50 coupled to housing 40; (ii) a drive screw 52 coupled to motor 50 and which rotates in response to actuation of motor 50; and (ii) drive nut 54 movably coupled on drive screw 52 such that movement of drive screw 52 moves drive nut 54 in a linear direction with respect to housing 40. Drive screw assembly 42 further comprises a mounting bracket 68. Drive screw 52 is pivotally coupled to mounting bracket 68.

Gear 44 is pivotally coupled to a post 55 extending from drive nut 54. Movement of drive nut 54 in a linear direction causes gear 44 to rotate as gear 44 moves along rack 46. First pivot arm 22 is coupled to gear 44. Linear movement and rotation of gear 44 along rack 46 thus moves pivot arm 22 in an arcuate and linear motion. This arcuate and linear motion causes pivot arm 22 to follow a half-elliptical path as arm 22 moves both linearly and arcuately.

Preferably, pivoting assembly 18 comprises a second gear 56 pivotally coupled to drive nut 54 on an opposing side of drive nut 54 from first gear 44. Second pivot arm 34 is coupled to second gear 56 and interfaces with a second toothed rack 58 is located between housing 40 and second gear 56. Second gear 56 rotates simultaneously with first gear 44 and pivot arm 34 moves parallel to first pivot arm 22.

Gears 44, 56 interface with respective racks 46, 58, each rack mating with teeth of gears 44, 56 in an engaging relationship as gears 44, 56 move along racks 46, 58. Upon movement of gears 44, 56 in an arcuate direction, arms 22, 34 coupled to gears 44, 56 also move in an arcuate direction. Motor 50 has an electrical cord 51 coupled thereto.

Upon actuation of motor 50, drive screw 52 turns, causing drive nut 54 to travel away from the first position shown in FIG. 3 to the second position shown in FIG. 4. As drive nut 54 travels in a linear direction, first and second gears 44, 56 pivot about drive nut 54 as teeth of gears 44, 56 engage corresponding teeth of toothed racks 46, 58. The pivoting motion of first and second gears 44, 56 causes the respective first and second pivot arms 22, 34 to move in an arcuate direction from the first position to the second position while the linear motion of drive nut 54 causes first and second pivot arms 22, 34 to move in a linear direction.

Thus, operation of opening assembly 16 causes pivot arms 22, 34 to move both in an arcuate direction and in a linear direction. This provides an increased range of motion, providing greater clearance for pivot arms 22, 34 and link arm 28 of assembly 10 when assembly 16 is coupled to post 12 and gate 14.

As mentioned above, an example of a single pivot arm 22*a* which links to both gears 44*a* and 56*a* and to a single or dual link arms is shown in FIG. 4*a*.

Figure 6:
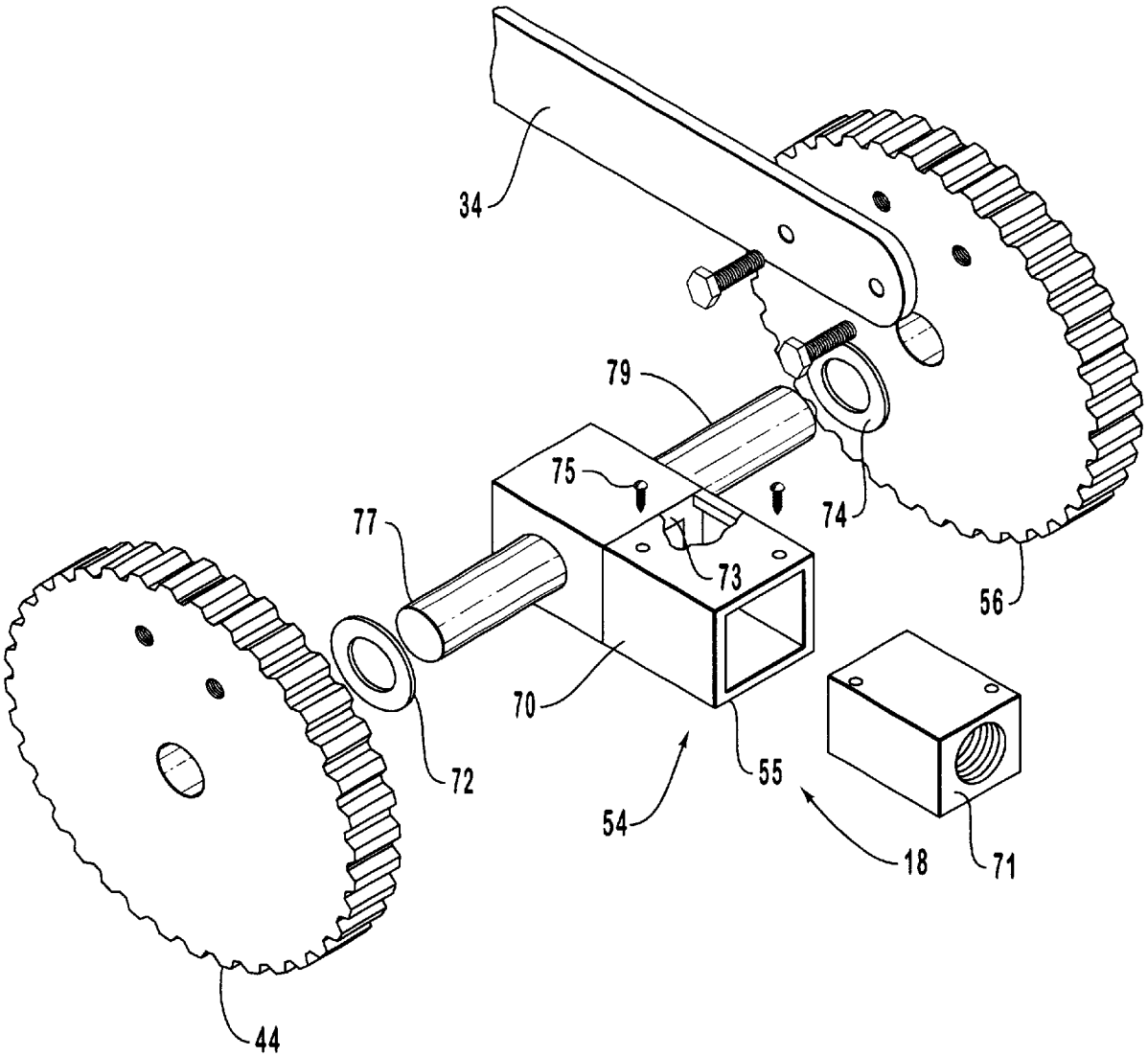
FIG. 6 demonstrates an exploded, cutaway view of a portion of the gate opening of FIGS. 4 and 5.

FIG. 6 demonstrates an exploded view of a portion of gate opening assembly 16. As shown, lead nut 54 of pivoting assembly 18 comprising first and second pins 77, 79 extending outwardly from a hollow tubular lead nut housing 70. First and second washers 72, 74 are coupled to respective pins 77, 79. Gears 44, 56 rotate about respective pins 77, 79.

A threaded bushing 71 is coupled inside drive nut housing 60, and may be comprised of nylon or Delrin, for example. During assembly, bushing 71 is threadedly coupled to the drive screw 52. Bushing 75 is seated inside hollow housing 70 against a seat 73. Bushing 71 is coupled to housing 70, such as through the use of screws 75, welding or an adhesive. Screws or bolts or other affixing means can be employed to affix first and second pivot arms 22, 34 to respective opposing first and second gears 44, 56.

In one embodiment, gears 44, 56 are maintained on respective pins 77, 79 by being held thereon by respective pivot arms 22, 34, (or by being coupled to a single pivot arm 22*a*), for example. Respective pivot arms are coupled to each other by a pivot pin 81 (FIG. 3) extending between arms 22, 34 and pivotally coupling pivot arms 22, 34 to link arm 28, for example and/or through the use of a cross member 83 (FIG. 7) coupling arms 22, 34 in parallel relationship.

It will be appreciated however that a variety of different mechanisms for pivoting assembly 18 and connector 20 are available to achieve the improved range of motion achieved when pivoting assembly 18 moves pivot arms 22, 34 in both a linear and an arcuate direction.

Drive nut 54 may have a variety of different configurations, a variety of different washers, or friction reducers may be employed, and pivot arms 22, 34 may have a variety of different shapes such as a straight shape, a substantial L-shape or a variety of different configurations which enable linkage of pivoting assembly 18 to pivot arms 22 and 34. Pivot arms 22, 34 (or a single pivot arm 22*a*) and/or one or more link arms 28 may be selectively telescoping members to thereby achieve different patterns of motion.

Figure 7:
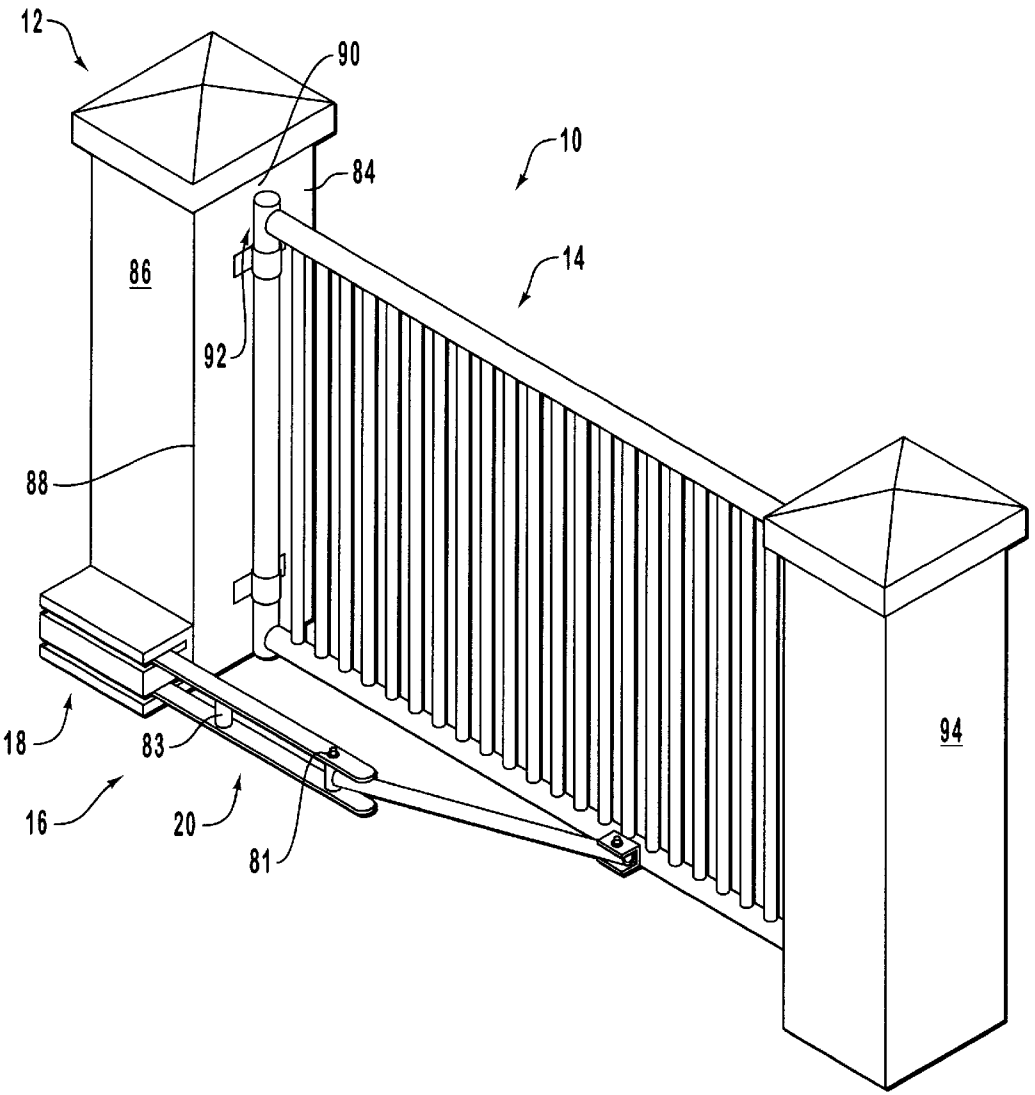
FIG. 7 demonstrates another view of the gate assembly of FIG. 2 in a closed position, demonstrating the pivotal coupling of the gate in the center of a first face of the post.

With reference now to FIG. 7, first substantially planar face 84 of post 12 is shown. Second substantially planar face 86 of post 12 is substantially transverse to first substantially planar face 84. Gate 14 is pivotally coupled to first substantially planar face 84 remotely from a corner 88 of post 12 at the intersection of surfaces 84, 86.

As one example of such remote pivotal coupling, gate 14 is shown as being pivotally coupled to the approximate center portion 90 of a first substantially planar face 84 of post 12. In one embodiment of such remote coupling, a space of at least about 5 inches in length exists between the pivot point 92 of the gate and the corner 88 of the post at the intersection of the first and second substantially planar surfaces. In another embodiment of remote coupling, the space between the corner 88 and the pivot point 92 is at least about 6 inches in length. In another embodiment of remote coupling, the space between the corner 88 and the pivot point 92 is at least about 8 inches in length. In another embodiment of remote coupling, the space between the corner 88 and the pivot point 92 is at least about 12 inches in length. In another embodiment of remote coupling, the space between the comer 88 and the pivot point 92 is at least about 20 inches in length.

Figure 8:
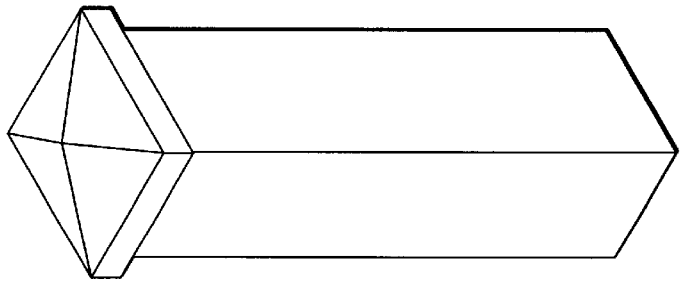
FIG. 8 demonstrates the gate assembly of FIG. 7 in an open position.
Figure 8:
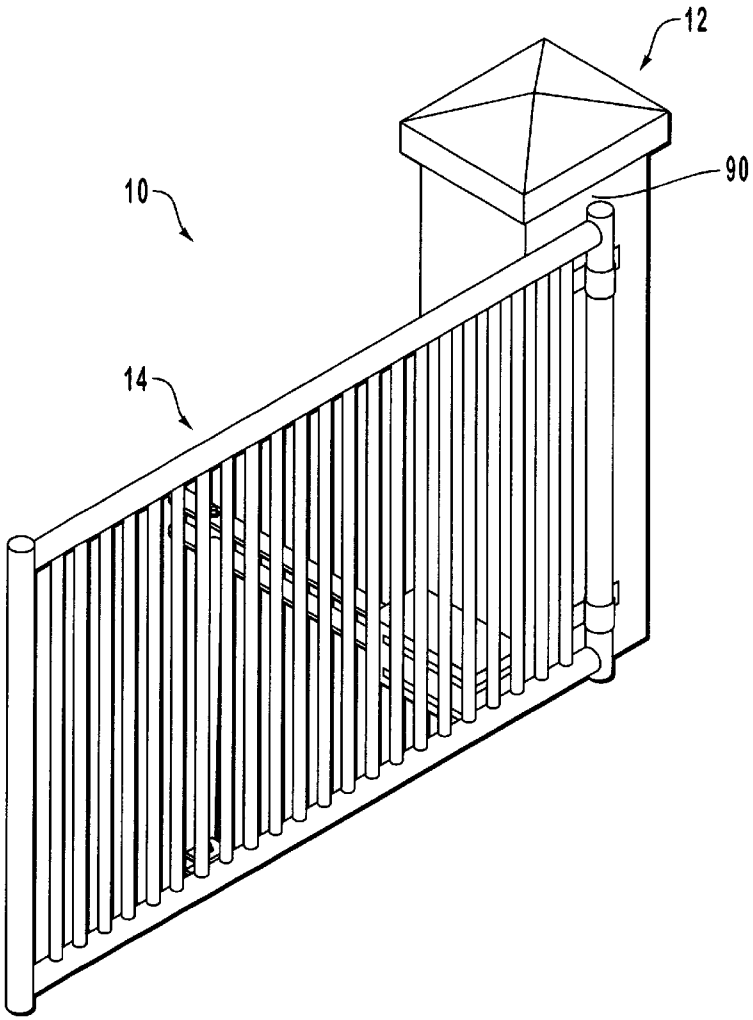

Gate 14 is shown in FIG. 7 in a closed position. However with reference now to FIG. 8, upon actuating assembly 16, gate 14 is opened and moves approximately 90° from the closed position to the open position. As shown, there is no interference between connector 20 and a corner 88 of post 12. Pivoting assembly 18 can be coupled to second substantially planar surface 86 of post 12, yet cause connector 20 to conveniently negotiate corner 88 of post 12. Gate 14 and assembly 16 can be conveniently serviced or replaced because of the distance separating the pivot point 92 of gate 14 and pivoting assembly 18.

Opening assembly 16 of the present invention is particularly useful with can conveniently comprise a square post 12, a rectangular post, or a variety of different posts having a comer intersecting first and second substantially planar, substantially transverse surfaces. Assembly 16 is particularly useful when a corner or similar structure is oriented between assembly 16 and the pivot point of the gate on the post.

However, it will be appreciated from a review of this specification and drawings that a variety of different gate posts may be employed in the present invention including circular posts, round posts, oblong-shaped post, elliptical-shaped posts, square-shaped posts, rectangular-shaped posts, oblong, irregular, triangular, star-shaped, half-moon-shaped, and posts having a variety of related or other shapes and that assembly 16 may be advantageously used in conjunction with any of such posts.

It will also be appreciated that a variety of different gates may be employed in the present invention including chain-link-type gates, gates having parallel cross-members, gates comprises hinges or pivot points, or a single hinge or a single pivot point, gates having a straight, flat member or slab, gates having irregular shapes, gates having decorative features thereon, wooden gates, steel gates, gates comprising a composite material, gates comprising a solid material, or a variety of different gates which are presently on the market or yet to be produced.

A second post 94 on an opposing side of a road or walkway and a portion of a fence 96 (FIG. 1) coupled to a third face of first post 12 are optional features for system 10.

It will also be appreciated that a variety of different mechanisms may be employed for selectively actuating opening assembly 16, such as electronic sensors, off/on switches, audible or visual sensors, computers, heat sensors, or a variety of other sensors of any kind. It will also be appreciated that gate opening assembly 16 may be used in a variety of different settings such as opening a gate, or moving a variety of different devices or objects.

Gate opening assembly 16 has many advantages. First, assembly 16 enables a user to mount the pivoting first end 36 of gate 14 remotely from the comer 88 of a square or rectangular post 12 without sacrificing the full clearance or movement potential of gate 14. Second, pivoting assembly 18 may be conveniently mounted onto a second face 86 of post 12 which is substantially transverse to a first face 84 while gate 14 is conveniently mounted remotely from comer 88 on the first face 84 of the post, such as in the center of the first face 84. Furthermore, gate opening assembly 16 is readily subject to service, repair, or replacement.

Drive screw assembly 42 is an example of linear extending assembly comprising a first member (e.g., screw 52) and a second member (e.g., nut 54) movably coupled to the first member. Gears 44, 56 are pivotally coupled to the second member (e.g., nut 54) of the linear extending assembly, and are configured to rotate as the second member (e.g. nut 54) advances in a linear direction. Pins or individual teeth coupled to housing 40 beneath gears 44, 56 may also be employed to cause gears 44, 56 to rotate. Gears 44, 56 may be configured to rotate in a variety of manners during the linear advancement thereof, such as by including pins, teeth, or a rack on the sides of nut 54 or on the sides of housing 40, for example, thereby causing the gears 44, 56 to rotate as nut 54 advances linearly. Thus, such pins, teeth, racks or racks 46, 58 mounted below, above, or on the sides of gears 44, 56 serve as examples of means for rotating gears 44, 56 as gears 44, 56 are extended linearly.

In addition, a variety of other examples of linear extending assemblies may be employed in the present invention, such as a linear actuator, an extension motor, a piston a ram (such as a hydraulic or pneumatic ram), a telescoping assembly, and any other assembly having a first member which is selectively linearly extended with respect to a second member. Pivoting assembly 18 is an example of means coupled to an opposing end of the connector 20 for selectively moving the connector in both a linear and an arcuate direction such that the movement of the connector rotates the gate between the closed position and the open position. Other examples of such means for selectively moving the connector include the examples of linear extending assemblies recited above. Opening assembly 16 is an example of gate opening means coupled to the gate for selectively moving the gate between the open position and the closed position.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An automatic gate opening assembly configured to selectively move a gate between an open position and a closed position, the automatic gate opening assembly comprising:

a connector configured to be coupled at one end thereof to a gate, the connector comprising a pivot arm and a link arm, each of the pivot arm and the link arm having a first end and an opposing second end, wherein the first end of the link arm is pivotally coupled to a second end of the pivot arm; and means coupled to the first end of the pivot arm for selectively moving the connector, the means for selectively moving the connector moving a pivot axis of the first end of the pivot arm as the connector is moved such that the movement of the connector moves the gate between the closed position and the open position.

2. An automatic gate opening assembly as recited in claim 1, wherein the means for selectively moving the connector comprises a linear extending assembly and a gear rotatably coupled to the linear extending assembly, and wherein a pivot axis of the gear moves upon actuation of the linear extending assembly.

3. An automatic gate opening assembly as recited in claim 2, wherein the gear is configured to rotate as a member of the linear extending assembly advances in a linear direction and wherein the pivot arm is coupled to the gear such that rotation of the gear during the advancement of the member moves the pivot arm in an arcuate and linear motion.

4. A gate opening assembly as recited in claim 2, wherein the gear comprises a toothed gear and the gate opening assembly further comprises a toothed rack configured to interface with the toothed gear, the gear moving from one portion of the toothed rack to another portion of the toothed rack upon actuation of the linear extending assembly, such that movement of a member of the linear extending assembly in a linear direction rotates the gear as the gear moves along the rack.

5. A gate opening assembly as recited in claim 2, wherein the assembly comprises means for rotating the gear as the gear is extended linearly by the linear extending assembly.

6. A gate opening assembly as recited in claim 5, wherein the means for rotating the gear comprises a rack interfacing with the gear.

7. An automatic gate opening assembly configured to selectively move a gate between an open position and a closed position, the automatic gate opening assembly comprising:

a pivoting assembly;

a pivot arm coupled to the pivoting assembly, the pivot arm having a first end and an opposing second end, the first end of the pivot arm being coupled to the pivoting assembly, the first end of the pivot arm having a pivot axis; and a link arm having a first end and a second end, the first end of the link arm being pivotally coupled to the second end of the pivot arm, wherein the pivot axis of the first end of the pivot arm moves as the pivoting assembly moves.

8. A gate opening assembly as recited in claim 7, wherein the pivoting assembly comprises:

(i) a linear extending assembly comprising a first member and a second member movably coupled to the first member; and (ii) a gear pivotally coupled to the second member of the linear extending assembly, the gear configured to rotate as the second member of the linear extending assembly advances in a linear direction with respect to the first member, the gear having a pivot axis that moves with respect to the first member upon actuation of the linear extending assembly.

9. A gate opening assembly as recited in claim 8, wherein the second member of the linear extending assembly comprises a drive nut and wherein the first member of the linear extending assembly comprises a drive screw.

10. A gate opening assembly as recited in claim 8, wherein the gear comprises a toothed gear pivotally coupled to the second member of the linear extending assembly and the gate opening assembly further comprises:

a toothed rack configured to interface with the toothed gear, such that movement of the second member in a linear direction with respect to the first member rotates the gear as the gear moves along the rack, the gear moving from one end of the rack to another; and a pivot arm coupled to the gear such that rotation of the gear along the rack moves the pivot arm in an arcuate and linear motion along the rack.

11. A gate opening assembly as recited in claim 7, wherein the pivot arm moves in an half-elliptical path during operation of the pivotting assembly.

12. An automatic gate assembly, comprising:

a post;

a gate pivotally coupled to the post, the gate pivoting between an open position and a closed position;

gate opening means for selectively moving the gate between the open position and the closed position, the gate opening means comprising:

a connector coupled at one end thereof to the gate; and means for selectively moving the connector in both a linear and an arcuate direction such that the movement of the connector rotates the gate between the closed position and the open position, the means for selectively moving the connector comprising: (i) a linear extending assembly having a first member and a second member movably coupled to the first member; and (ii) a gear rotatable coupled to the linear extending assembly, the gear having an axis of rotation, wherein the axis of rotation of the gear moves with respect to the first member of the linear extending assembly as the connector is moved.

13. An assembly as recited in claim 12, wherein the closed position of the gate is approximately 90 degrees away from the open position of the gate, and wherein the means for selectively moving the connector in both a linear and an arcuate direction rotates approximately 180 degrees, thereby pivoting the gate approximately 90 degrees from the closed position to the open position.

14. An assembly as recited in claim 12, wherein the post has a substantially square cross-sectional shape.

15. An assembly as recited in claim 12, wherein the post has a substantially rectangular cross-sectional shape.

16. An automated gate assembly, comprising:

a post;

a gate pivotally coupled to the post, the gate pivoting between an open position and a closed position;

a gate opening assembly coupled to the gate, the gate opening assembly comprising:

a pivoting assembly which selectively and simultaneously moves in both a linear and arcuate direction, said pivoting assembly comprising:

(i) a linear extending assembly, the linear extending assembly having a first member and a second member movably coupled thereto; and (ii) a gear having an axis of rotation, the gear being movably coupled to the linear extending assembly; and a connector connecting the pivoting assembly to the gate whereby actuation of the pivoting assembly rotates the gate from the open position to the closed position, wherein the axis of rotation of the gear moves with respect to the first member of the linear extending assembly as the pivoting assembly moves.

17. An assembly as recited in claim 16, wherein the connector comprises:

(i) a pivot arm having a first end and a second end, the first end of the pivot arm being coupled to the pivoting assembly; and (ii) a link arm having a first end and a second end, the first end of the link arm being pivotally coupled to the pivot arm and the second end of the link arm being pivotally coupled to one of:

(i) an intermediate portion of the gate; and (ii) a second end of the gate.

18. An assembly as recited in claim 16, wherein the ratio of rotation between the pivoting assembly and the gate is approximately 2:1.

19. An automated gate assembly, comprising:

a post;

a gate pivotally coupled to the post;

an automatic gate opening assembly coupled to the post;

wherein the automatic gate opening assembly comprises gate opening means coupled to the gate for selectively moving the gate between the open position and the closed position, the gate opening means pivotally coupled to the gate, the gate opening means comprising:

a connector coupled at one end thereof to the gate, wherein the connector comprises:

(i) a pivot arm having a first end and a second end; and (ii) a link arm having a first end and a second end, the first end of the link arm being pivotally coupled to the second end of the pivot arm; and means for selectively moving the connector in both a linear and an arcuate direction such that the movement of the connector rotates the gate between the closed position and the open position, the means for selectively moving the connector in both a linear and an arcuate direction comprising: (i) a linear extending assembly having a first member and a second member movably coupled to the first member; and (ii) a gear rotatably coupled to the linear extending assembly, the gear having an axis of rotation, wherein the axis of rotation of the gear moves with respect to the first member of the linear extending assembly when the connector is moved.

20. An assembly as recited in claim 19, wherein a pivot axis of the first end of the pivot arm moves in a linear direction as the second end of the pivot arm moves in an arcuate direction.

21. An assembly as recited in claim 20, wherein the means for selectively moving the connector in both a linear and an arcuate direction comprises a toothed rack configured to interface with the gear, the gear moving from one portion of the toothed rack to another portion of the toothed rack upon actuation of the linear extending assembly.

22. An assembly as recited in claim 21, wherein the first member of the linear extending assembly remains stationary with respect to the post as the second member of the linear extending assembly moves with respect to the post.

* * * * *